US006824133B2

(12) United States Patent
Richtsmeier

(10) Patent No.: US 6,824,133 B2
(45) Date of Patent: Nov. 30, 2004

(54) STACK MONITORING METHOD AND SYSTEM

(75) Inventor: Dean Richtsmeier, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 126 days.

(21) Appl. No.: 10/272,747

(22) Filed: Oct. 17, 2002

(65) Prior Publication Data

US 2004/0075210 A1 Apr. 22, 2004

(51) Int. Cl.[7] ..... B65H 1/18

(52) U.S. Cl. ..... 271/153; 271/152; 271/154; 271/155; 271/126; 271/160

(58) Field of Search ..... 271/10.02, 10.03, 271/25, 31, 38, 110, 111, 130, 145, 160, 126, 125, 152, 153

(56) References Cited

U.S. PATENT DOCUMENTS

| | | | |
|---|---|---|---|
| 3,105,908 | A | 10/1963 | Burkhardt et al. |
| 4,737,645 | A | 4/1988 | Lahr |
| 5,286,018 | A | 2/1994 | Rasmussen et al. |
| 5,709,381 | A | 1/1998 | Hourtash et al. |
| 5,718,424 | A | 2/1998 | Nakatani et al. |
| 5,996,989 | A | 12/1999 | Cahill et al. |
| 6,145,831 | A | 11/2000 | Inoue et al. |

*Primary Examiner*—Donald P. Walsh
*Assistant Examiner*—Kaitlin Joerger

(57) ABSTRACT

Disclosed herein is a stack monitoring system for an imaging apparatus for monitoring media reserves.

10 Claims, 9 Drawing Sheets

STACK MONITORING METHOD AND SYSTEM

BACKGROUND

An imaging apparatus is a device commonly utilized to create an image on a sheet of media. An imaging apparatus may be provided with a stack of individual sheets of media, a media tray, a pick mechanism and a lift plate. The stack is commonly located on the lift plate. The lift plate may be part of the media tray. The media tray may be permanently attached to the imaging apparatus, or may be removable from the imaging apparatus. The lift plate commonly moves the stack towards the pick mechanism. The pick mechanism can remove one sheet from the stack and introduce it to the imaging apparatus. While the single sheet of media passes through the imaging apparatus, the image may be formed thereon.

As sheets of media are sequentially picked by the pick mechanism and processed by the imaging apparatus, the thickness of the stack decreases. When the stack thickness is zero, media reserves have been depleted and printing must stop until the stack is replenished.

SUMMARY

In one exemplary embodiment apparatus and methods for monitoring a stack of media contained within an imaging apparatus may include: a lift plate upon which the stack is disposed; a gate located in the imaging apparatus, the gate comprising an open state and a closed state; a first flag attached to the lift plate, wherein the first flag is positioned in the gate, the first flag comprising at least one graduation; wherein the imaging apparatus comprises a first condition and a second condition; wherein, in the first condition, the first flag graduation is located in the gate thereby placing the gate in the open state; and wherein, in the second condition, the first flag graduation is not located in the gate thereby placing the gate in the closed state.

BRIEF DESCRIPTION OF THE DRAWING

Illustrative embodiments are shown in Figures of the Drawing in which.

DETAILED DESCRIPTION

Figure 1:
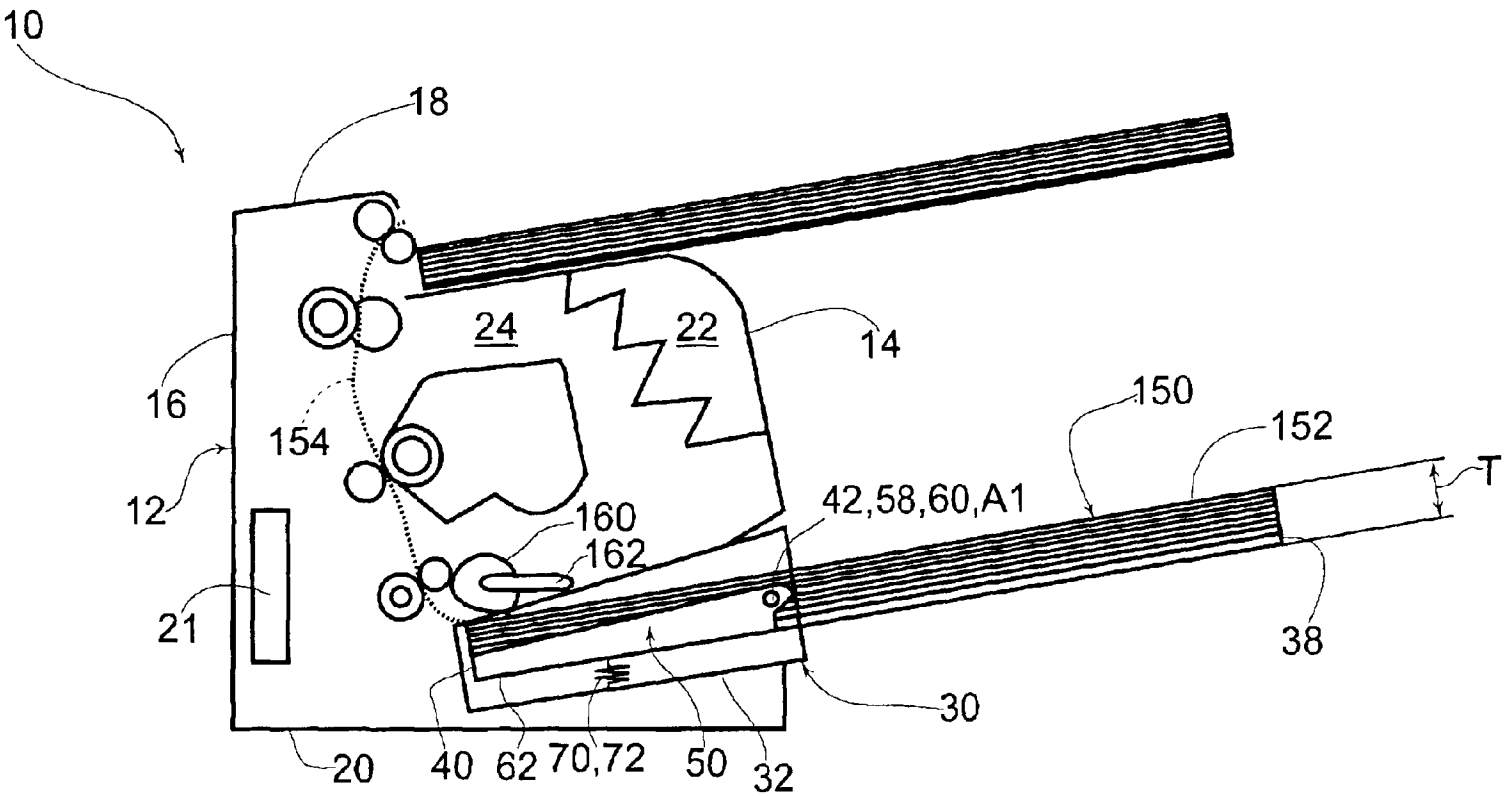
FIG. 1 shows a schematic side elevation diagram of an exemplary imaging apparatus.

In one exemplary embodiment of an imaging apparatus 10 illustrated in FIG. 1, a stack monitoring system monitors the number of sheets of media located in a stack 150.

Figure 2:
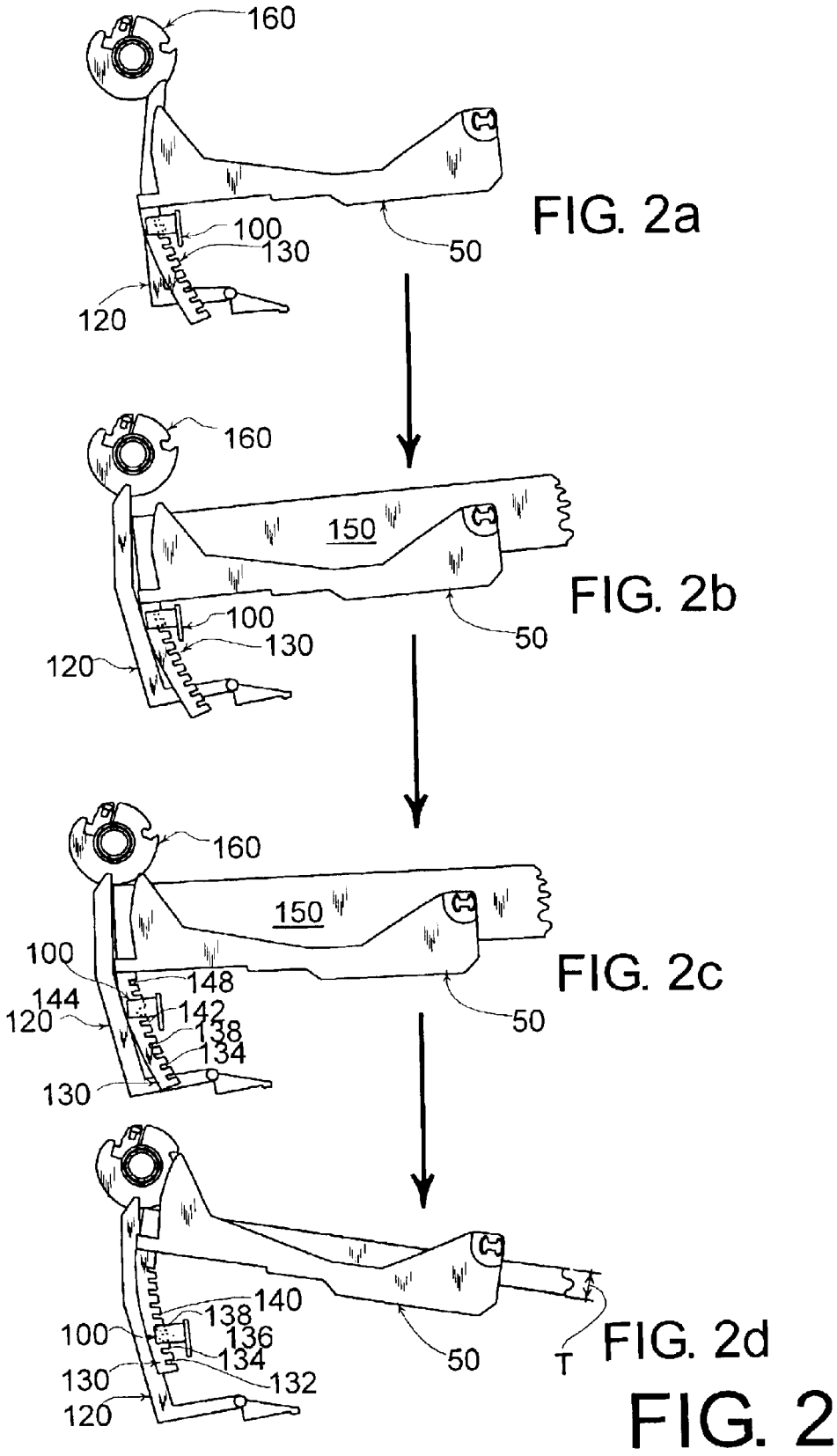
FIG. 2 shows a series of side elevation diagrams of an exemplary lift plate, stack and picker mechanism.

With reference to FIG. 2, the imaging apparatus 10 may be provided with a controller 21 (FIG. 1), a media tray 30 (FIG. 1), a lift plate 50, an optical gate 100, a stack present flag 120, a stack thickness flag 130 and a picker mechanism 160. The lift plate 50 may be located within the media tray 30 (FIG. 1). Additionally, the stack thickness flag 130 may be formed on the lift plate 50. This stack thickness flag 130 and the stack present flag 120 may pass through the optical gate 100.

Figure 6:
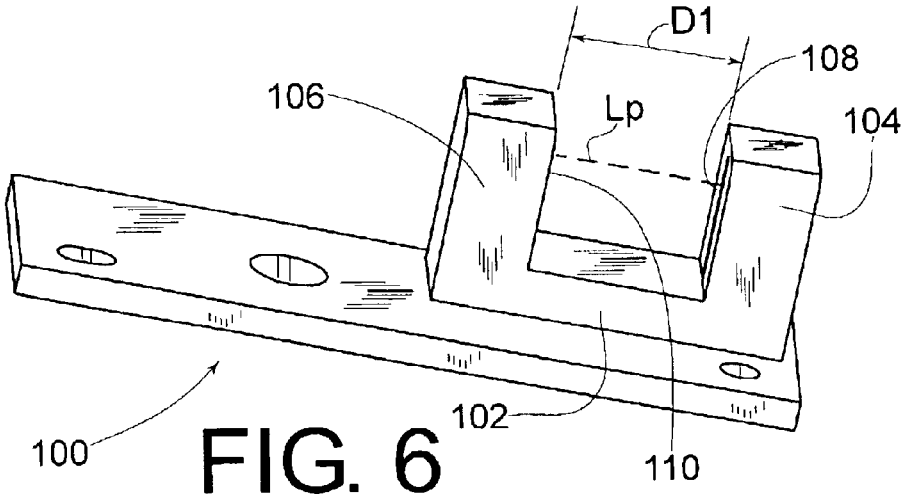
FIG. 6 shows a perspective view of the exemplary gate shown in FIG. 5.

With reference to FIG. 2*a,* upon receipt of an instruction to process media (e.g. printing), the controller 21 (FIG. 1) senses if the stack 150 is located on the lift plate 50. As shown in FIG. 2*b,* if the stack 150 is present, the controller 21 senses this presence because the optical gate 100 is in an open state (as a result of the stack 150 moving the media present flag 120 outside of the optical gate 100). It should be noted that the optical gate 100 may sense presence or absence of the media present flag 120 when the lift plate 50 is located as shown in FIG. 2*b.* This sensing of the media present flag 120 may be capable as a result of a media thickness flag graduation (e.g. graduation 148, FIG. 2*c*) being aligned with an optical gate light path Lp (FIG. 6). The details of this sensing of the media present flag 120 will be provided later herein. After sensing the presence of the stack 150, the controller 21 may cause the lift plate 50 (with the stack 150 located thereon) to move towards the picker mechanism 160 where a sheet of media can be picked from the stack 150. As illustrated in FIG. 2*c,* when the lift plate 50 moves towards the picker mechanism 160, the stack thickness flag 130 passes through the optical gate 100. The optical gate 100 senses this movement of the stack thickness flag 130 by sensing individual graduations 131 formed in the stack thickness flag 130. This sensing of the graduations 131 is reported to the controller 21 as a series of open and closed states. The controller 21 can track this opening and closing of the optical gate 100 and make computations based on these states. Based on the movement of the stack thickness flag 130, the controller 21 determines how many sheets of media are contained within the stack 150. After each 'pick' of a sheet of media from the stack 150, the lift plate 50 returns to the position shown in FIGS. 2*a* and 2*b*. Therefore, the lift plate 50 is frequently moving, thereby allowing the optical gate 100 to sense this movement via the stack thickness flag 130.

As the successive sheets of media are picked and processed, the stack 150 reduces in thickness T as illustrated in FIG. 2*b.* If the controller 21 determines that the stack 150 has too few sheets of media, the controller 21 can notify the user to fill the stack 150.

Imaging Apparatus Overview

With reference to FIG. 1, a schematic diagram depicts a simplified side elevation view of an exemplary imaging apparatus 10, such as a printer. The imaging apparatus 10 may include a housing 12. The housing 12 may include a front 14, a back 16, a top 18, a bottom 20, a first side 22 and a second side 24. Additionally, the imaging apparatus 10 may also be provided with a controller 21.

It is to be understood that terms such as 'front', 'back', 'top', 'bottom', 'horizontal', 'vertical', 'underneath' and the like are used herein for illustrative purposes only. In actual use, the imaging apparatus 10 can be configured and/or used in almost any orientation, thus making terms such as 'front', 'back', 'top', 'bottom', 'horizontal', 'vertical', etc. relative to the orientation of the imaging apparatus 10.

Media Tray

Figure 3:
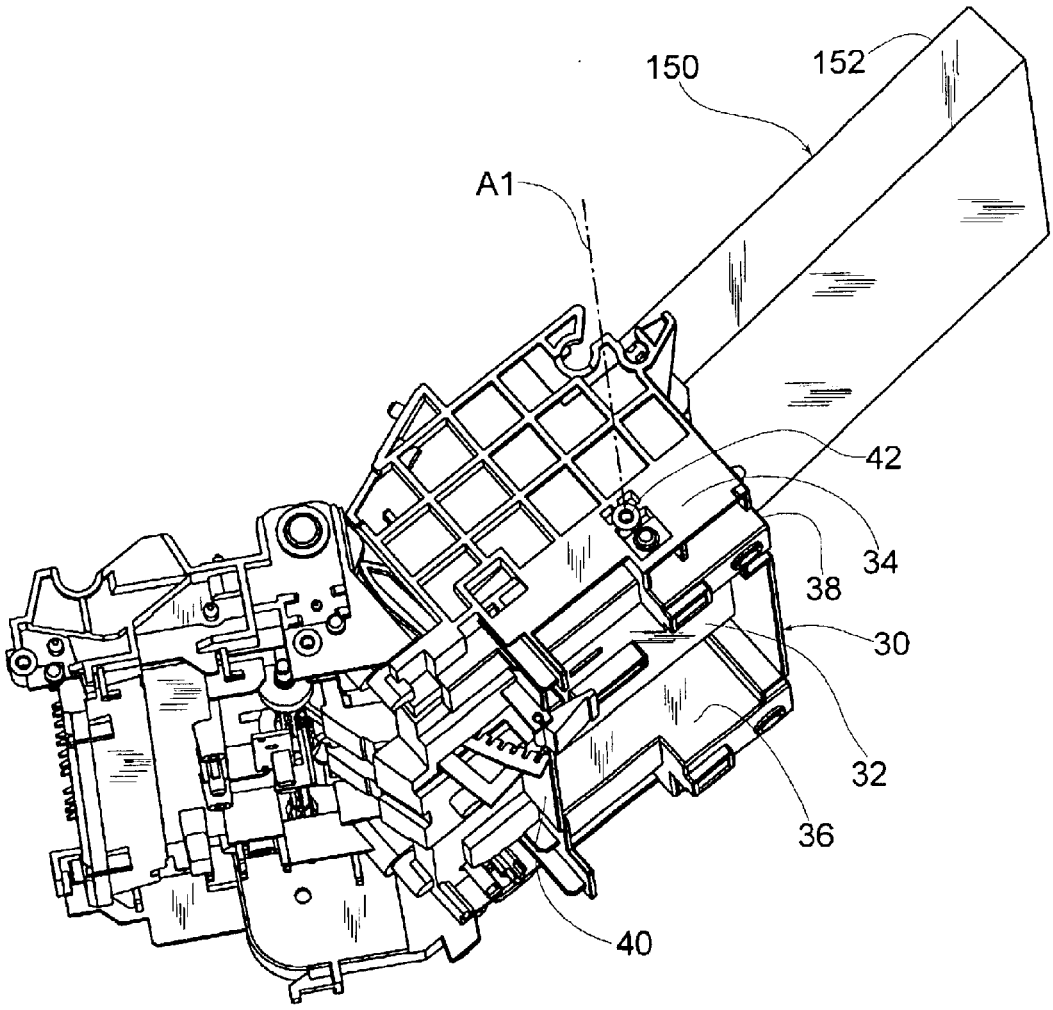
FIG. 3 shows a perspective view of a media tray portion of an imaging apparatus.

FIG. 3 shows the media tray 30 in further detail and other components associated therewith. The media tray 30 may be integrally formed in the printer as shown in FIG. 1, or, alternatively, may be a removable component. The media tray 30 may include a bottom portion 32, first side 34, a second side 36, a front portion 38 and a rear portion 40. The first and second sides 34, 36 may be formed substantially parallel to each other and perpendicular to the bottom portion 32. The media tray rear portion 40 may reside inside the imaging apparatus 10, while the front portion 38 may extend further beyond the imaging apparatus housing 12. The media tray 30 may be further provided with a first pivot receptacle 42 and a second pivot receptacle (not shown). The first pivot receptacle 42 may be formed in the first side 34 of the media tray 30. The second pivot receptacle may be formed in the second side 36 of the media tray 30.

Lift Plate

Figure 4:
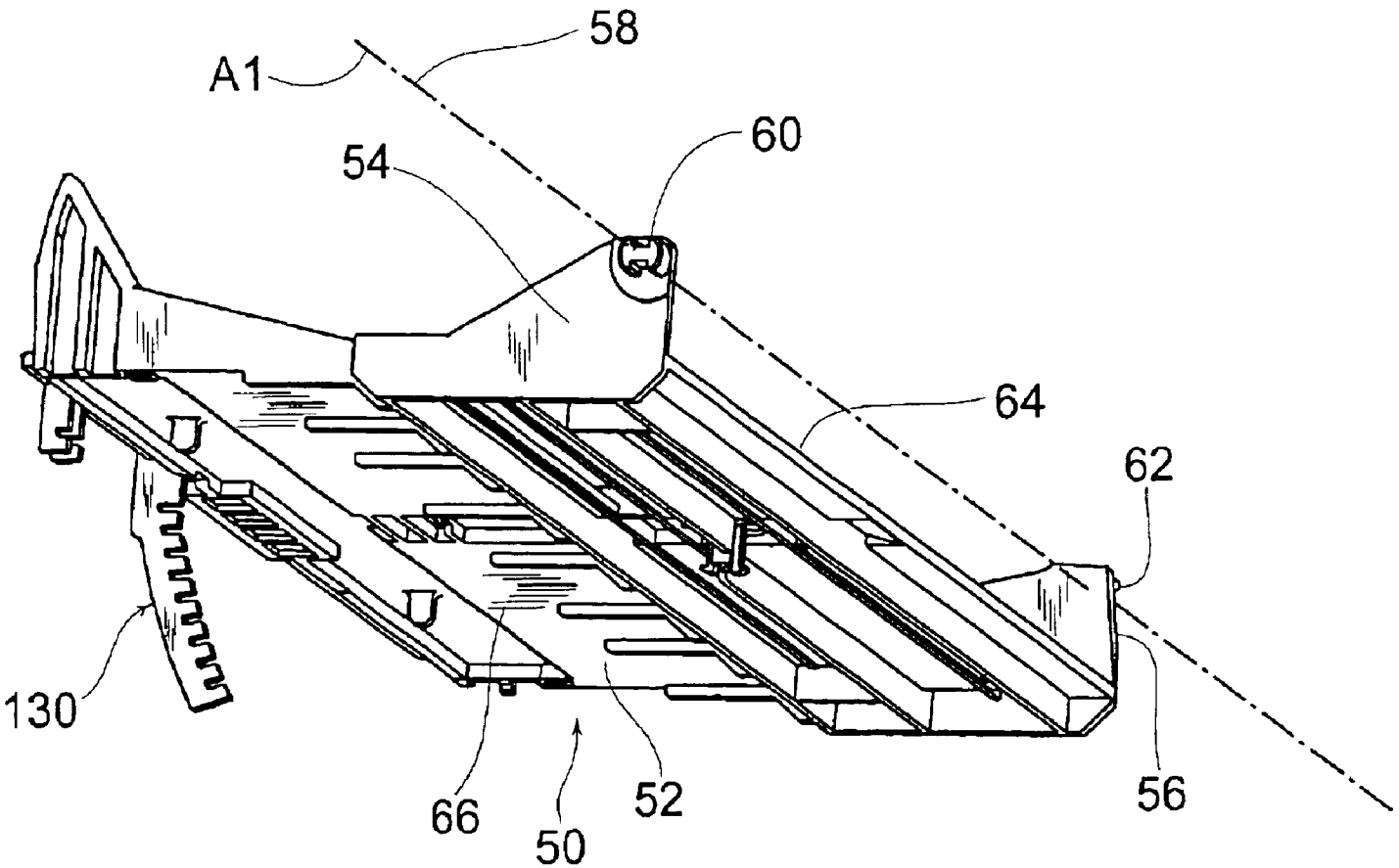
FIG. 4 shows a perspective view of a lift plate contained within the media tray of FIG. 3.

As shown schematically in FIG. 1, the media tray 30 may be provided with the lift plate 50 for introducing media to the picker assembly 160. With reference to FIG. 4, the lift plate 50 may be provided a bottom portion 52, a first side 54 and a second side 56. The first and second sides 54, 56 may be formed parallel to each other and perpendicular to the bottom portion 52.

The lift plate 50 may be further provided with a pivot 58 (defining a pivot axis A1). The lift plate 50 may rotate about the pivot 58 with respect to the media tray 30 (FIG. 3). The pivot 58 may include a first protrusion 60 and an oppositely disposed second protrusion 62 (FIG. 4). The pivot first protrusion 60 may be formed on the lift plate first side 54. The pivot second protrusion 62 may be formed on the lift plate second side 56. The lift plate bottom portion 52 may define an upper surface 64 and an oppositely disposed lower surface 66.

FIG. 1 illustrates how the lift plate 50 may be pivotally attached to the media tray 30 via the pivot 58. The first protrusion 60 may be received by the media tray first pivot receptacle 42. The second protrusion 62 may be received by the media tray second pivot receptacle (not shown), thereby pivotally attaching the lift plate 50 to the media tray 30 about the pivot axis A1. As shown schematically in FIG. 1, the media tray 30 may be provided with a pair of springs 70, 72. With reference to FIG. 1, the lift plate 50 may be biased away from the media tray bottom portion 32 by the springs 70, 72. The springs 70, 72 may urge the lift plate lower surface 66 away from the media tray bottom portion 32. Unless otherwise acted upon in a manner described later herein, the lift plate 50 is urged towards the picker assembly 160. Therefore, the stack 150 may be somewhat compressed between the lift plate 50 and the picker assembly 160. When the stack 150 is compressed between the lift plate 50 and the picker assembly 160, the lift plate 50 is in a position that may be referred to herein as a pick position (illustrated in FIGS. 12 and 13). Alternatively, when the lift plate 50 is urged away from the picker assembly 160, the lift plate 50 may be located in a position referred to herein as a load position (illustrated in FIGS. 10 and 11).

Optical Gate

Figure 5:
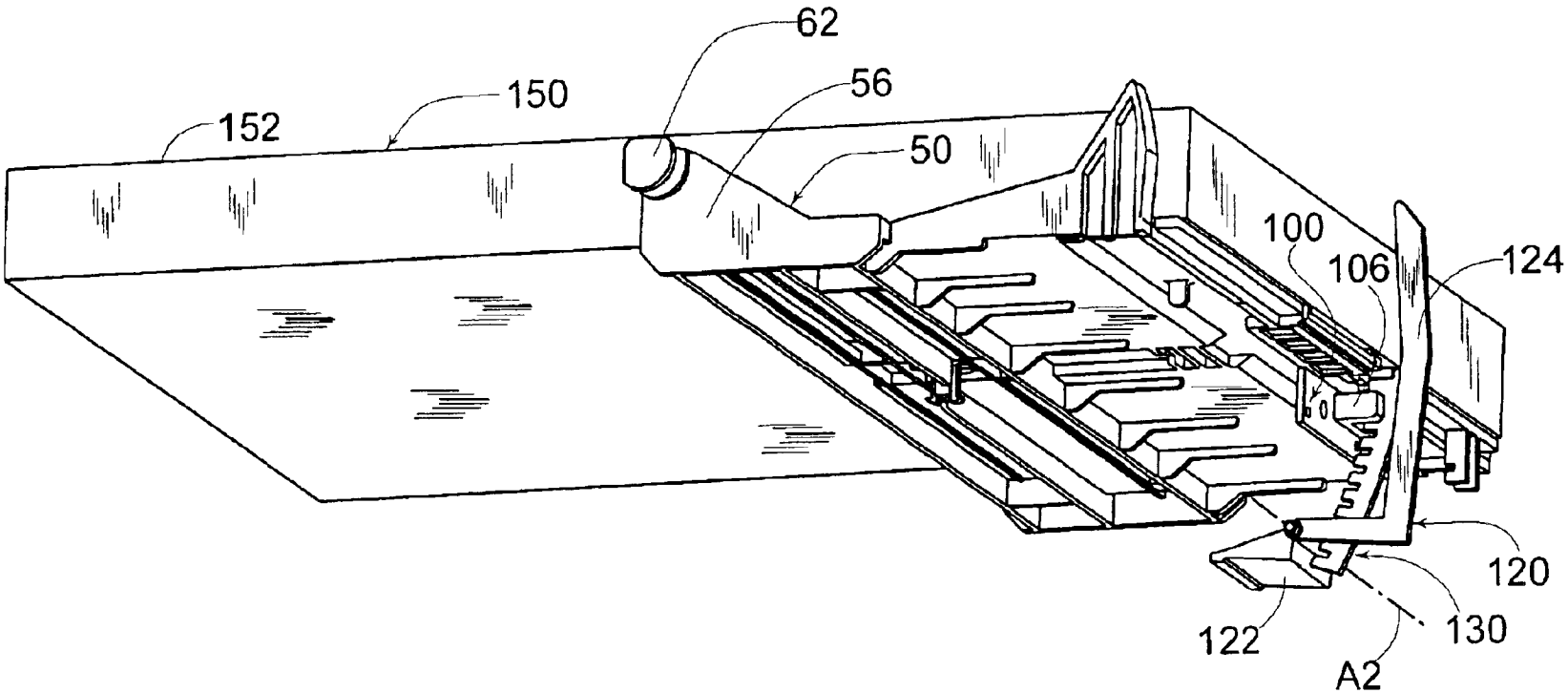
FIG. 5 shows a perspective view of the lift plate of FIG. 4 with a stack of media disposed thereon and an exemplary gate associated therewith.

With reference to FIG. 5, the imaging apparatus 10 (FIG. 1) may be provided with a sensor, such as the optical gate 100. It should be noted that the present description is directed to a sensor operating under photoelectric principles, however other alternatives may be employed (examples of these alternatives will be described later herein). This optical gate 100 may operate as a 'switch', this operation will be described later herein. The optical gate 100 may be fixedly located in the imaging apparatus 10 (e.g. fixedly mounted to the media tray 30, or, alternatively, to the imaging apparatus housing 12). It is noted that by fixedly locating the optical gate 100 it may move during certain operations, but remains fixed at a predetermined position during other (known) operations.

FIG. 6 illustrates the optical gate 100 in further detail. With reference to FIG. 6, it can be seen that the optical gate 100 may have a generally U-shaped configuration. The optical gate 100 may include a crown 102, a first leg 104 and a second leg 106. The optical gate 100 may be configured such that the crown 102 functions as a 'base' from which the first and second legs 104, 106 protrude. A separation distance 'D1' between the first and second legs 104, 106 may, for example, be about 0.25 inches. It is noted that the optical gate separation distance D1 may be varied as required due to design alternatives.

With continued reference to FIG. 6, the optical gate 100 may be provided with a light source 108 and a light receiver 110. In one exemplary embodiment, the light source 108 may be formed in one of the legs (e.g. the first leg 104). The light receiver 110 may be formed in the other leg (e.g. the second leg 106). The light source 108 and light receiver 110 may be electrically coupled to the controller 21, or, alternatively, electronics that are operatively associated with the imaging apparatus 10. One such electrical association between optical gate 100 and the imaging apparatus 10 may occur through conductors linking the optical gate 100 to the controller 21 (FIG. 1). Although the use of the optical gate 100 will be described in detail later, a brief description will now be provided. The light source 108 generates light that is projected towards the light receiver 110. This light may be traveling along a path denoted as 'Lp'. The optical gate 100 may have an open state and a closed state. The optical gate open state refers to a condition when light travels from the light source 108 to the light receiver 110 along the light path Lp. The optical gate closed state refers to a condition when light is obstructed along the light path Lp, thereby blocking the transmission of light from the light source 108 to the light receiver 110.

Stack Present Flag

Figure 7:
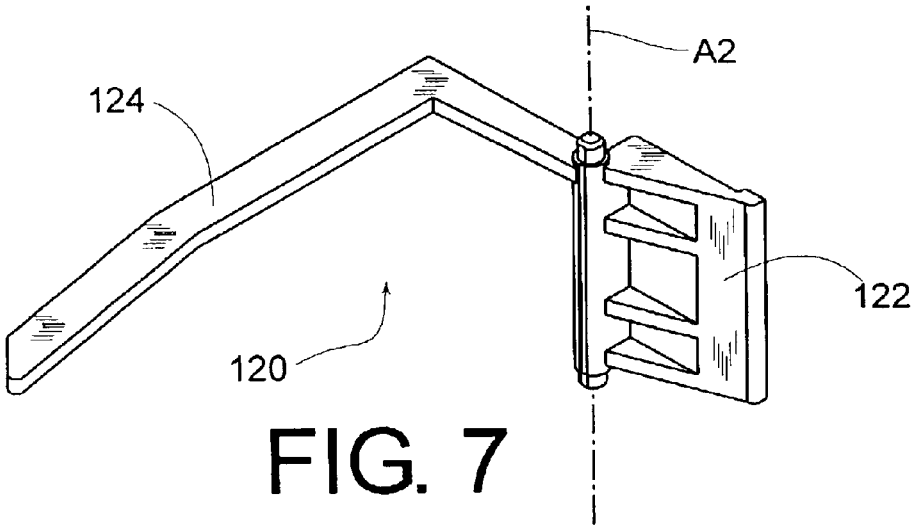
FIG. 7 shows a perspective view of a present flag.

With reference to FIG. 5, the stack present flag 120 may be provided for determining if the stack 150 is present in the media tray 30 (e.g. on the lift plate 50). It should be noted that the stack present flag 120 may be generically referred to herein as a flag (e.g. second flag). With reference to FIG. 7, the stack present flag 120 may be pivotally attached to imaging apparatus 10, or, alternatively, the media tray 30 about a second axis A2. The stack present flag 120 may be provided with a weighted portion 122 and a contact portion 124. The weighted portion 122 may serve to bias (via gravitational forces) the stack present flag 120 in a manner that will be described later herein.

Stack Thickness Flag

With reference to FIG. 5, the stack thickness flag 130 may be provided for assisting in the determination of a thickness of the stack 150 of media located in the media tray 30. It should be noted that the stack thickness flag 130 may be generically referred to herein as a flag (e.g. first flag). The stack thickness flag 130 may be configured such that it travels through the optical gate 100 in a manner that will be described later herein.

Figure 8:
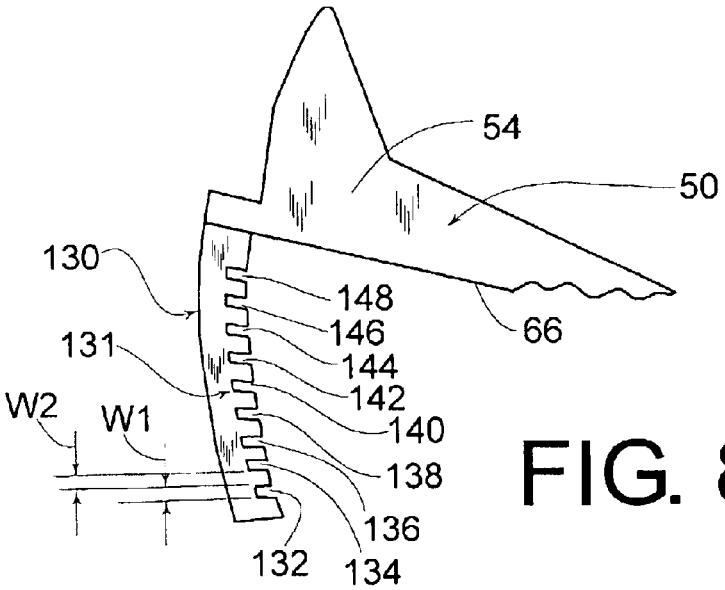
FIG. 8 shows a side elevation view of a portion of the lift plate of FIG. 4 with a thickness flag attached thereto.

FIG. 8 illustrates that the stack thickness flag 130 may be formed on the lift plate lower surface 66. The stack thickness flag 130 may be generally arcuate having a radius approximately equal to the distance between the stack thickness flag 130 and the lift plate pivot 58 (FIG. 4). The stack thickness flag 130 may be provided with a plurality of graduations 131 such as graduations 132, 134, 136, 138, 140, 142, 144, 146 and 148, FIG. 8. These graduations 131 may have uniform dimensions. A graduation width W1 defined by each of the graduations 131 may, for example, be about 0.06 inches, although other dimensions may be utilized. These graduations 131 may have uniform spacing there between. A spacing width W2 between each of the graduations 131 may, for example, be about 0.10 inches, although other dimensions may be utilized. The general function of the stack thickness flag 130 is to allow for monitoring movement of the lift plate 50.

Stack of Media

Figure 9:
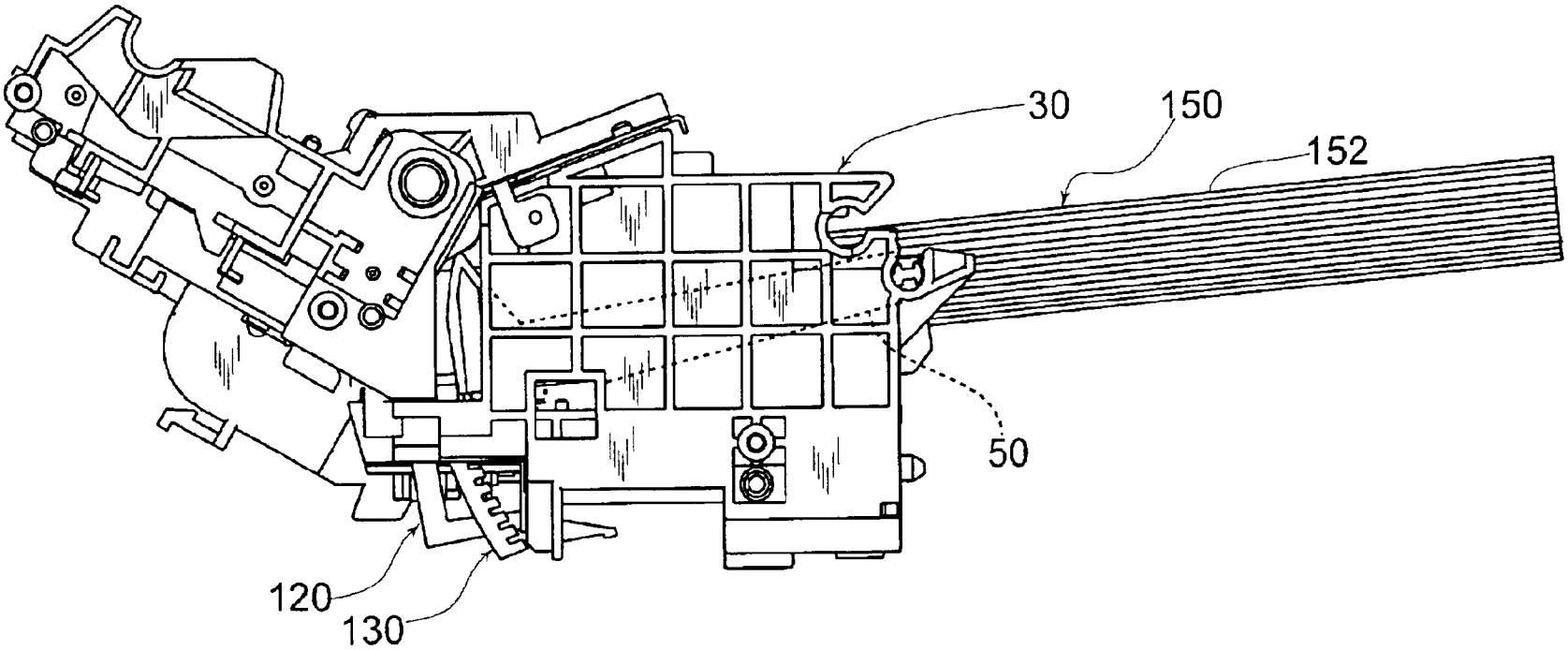
FIG. 9 shows a side elevation view of the media tray of FIG. 3 having a stack located on the lift plate of FIG. 5.

With reference to FIG. 9, the media tray 30 may contain the stack 150 of media. The stack 150 may include individual sheets of media such as sheet 152. With reference to FIG. 1, media, such as sheet 152 may travel from the stack 150 into and through the imaging apparatus 10 along a media path 154. The sheet 152 may be processed (e.g. forming an image thereon) while traveling along the media path 154.

Picker Assembly

Figure 10:
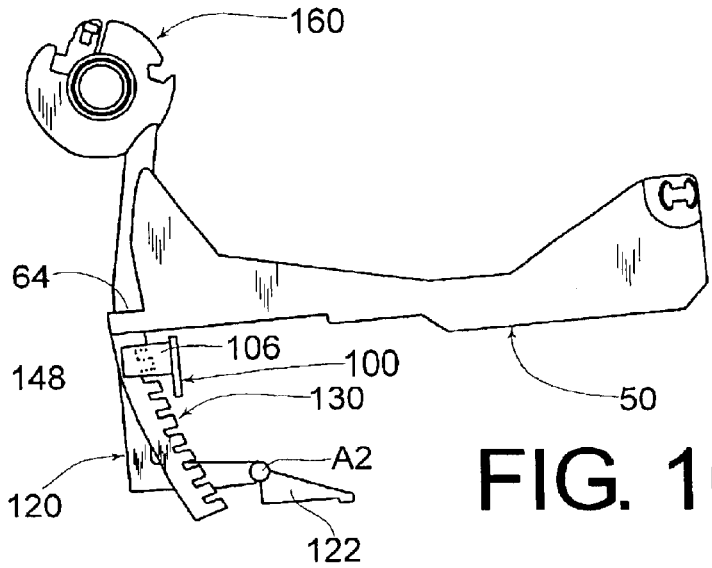
FIG. 10 shows a side elevation view of a lift plate and a picker assembly wherein the imaging apparatus is in an empty/load condition.
Figure 11:
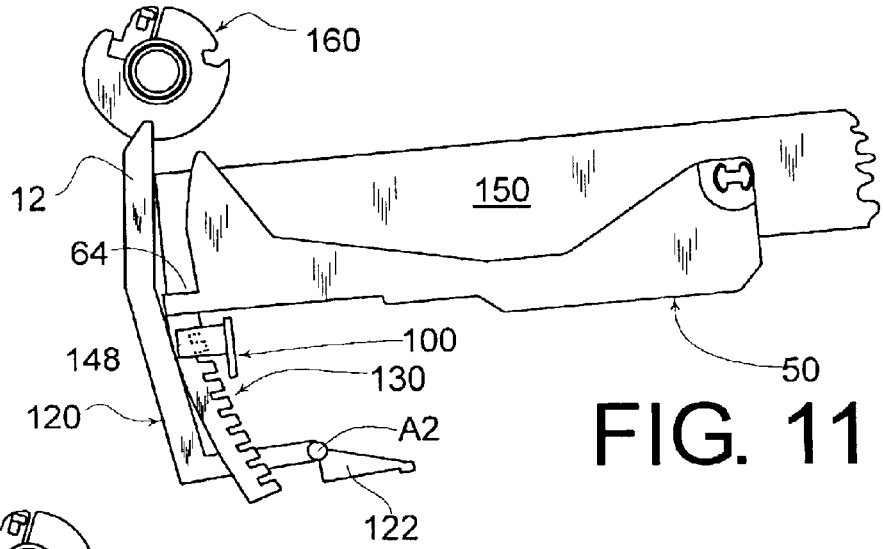
FIG. 11 shows a side elevation view of the lift plate and the picker assembly of FIG. 10 wherein the imaging apparatus is in a present/load condition.

With reference to FIG. 1, the picker assembly 160 may be any type of conventional pick mechanisms known in the art. Examples of pick mechanisms may be found in the following U.S. Pat. No. 5,996,989 for a SHEET SEPARATOR FRICTION PAD of Cahill et al. issued on Dec. 7, 1999; U.S. Pat. No. 6,145,831 for a SHEET FEEDER CAPABLE OF ELIMINATING OVERLAPPING SHEET FEED of Inoue et al. issued on Nov. 14, 2000; and, U.S. Pat. No. 5,718,424 for a SHEET FEEDING DEVICE HAVING A SEPARATING AND PRESTRESSING DEVICE of Nakatani et al. issued on Feb. 17, 1998 all of which are specifically incorporated by reference for all that is contained therein. In one type of known picker assembly 160, the picker assembly 160 may be provided with a lift plate actuator 162. The lift plate actuator 162 may be activated to urge the lift plate 50 to the load position (FIGS. 10 and 11). Examples of the lift plate actuators 182 may be found in the immediately preceding US Patent that were specifically incorporated by reference.

Operation of Apparatus

With reference to FIG. 1, at the outset, sheet 152 may be located on an uppermost position of the stack 150. The picker assembly 160 may be activated for separating sheet 152 from stack 150 and introducing the sheet 152 to the media path 154. The lift plate 50 may be biased towards a picker assembly 160 by the springs 70, 72. This biasing of the lift plate 50 may serve to place the sheet 152 against the picker assembly 160. Sheet 152 may be moved along the media path 154 by the picker assembly 160 and other components such as idler rolls, printer assembly rolls, etc. As subsequent sheets of media are processed by the imaging apparatus 10, the picker assembly 160 continues to feed sheets of media (one sheet at a time) from the stack 150 to the media path 154. It should be noted that after each sheet is fed, the lift plate 50 moves to the load position (FIGS. 10 and 11).

Figure 13:
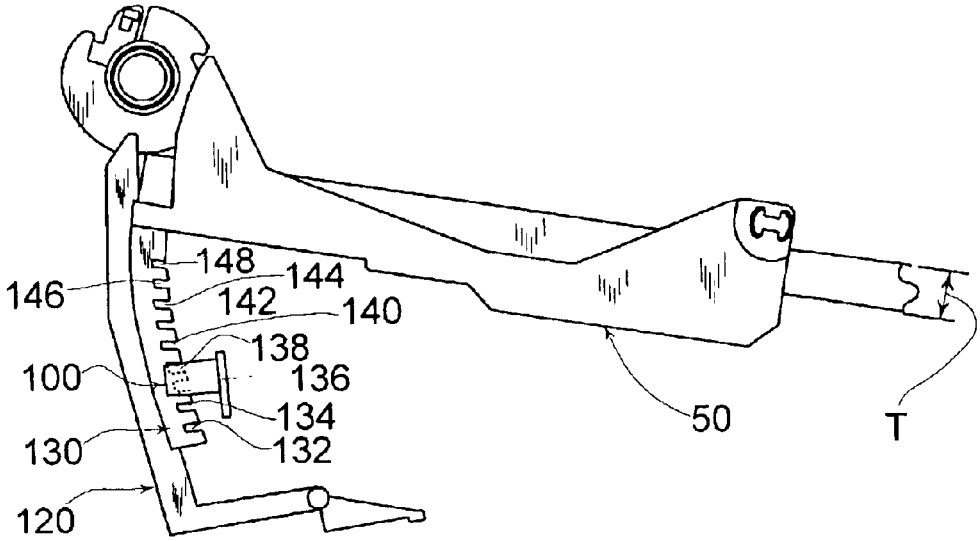
FIG. 13 shows a side elevation view of the lift plate and the picker assembly of FIG. 10 wherein the imaging apparatus is in a second 'snapshot' of the present/pick condition of FIG. 12.

Since the stack 150 contains a finite quantity of sheets, each individual picking of a sheet (e.g. sheet 152) reduces a stack thickness 'T' by the thickness of the sheet. The thickness of the sheet may be referred to herein as a sheet thickness 'Ts'. Conventional office-type media used in imaging devices may have a sheet thickness Ts of about 0.004 inches. Therefore, each picking of a sheet reduces the stack thickness 'T' by about 0.004 inches. The picking of sheets may continue until the stack thickness T is reduced to zero (at which time the stack 150 no longer exists). This depletion of the stack 150 may result in the lift plate 50 pivoting towards the picker assembly 160 (as illustrated in FIG. 13). In a process described in detail later herein, the imaging apparatus 10 may count the number of sheets processed and compare this number to the movement of the lift plate 50. By comparing lift plate movement to the number of sheets processed and monitoring the location of the lift plate 50, the number of sheets contained within the stack 150 may be determined.

Conditions

Figure 12:
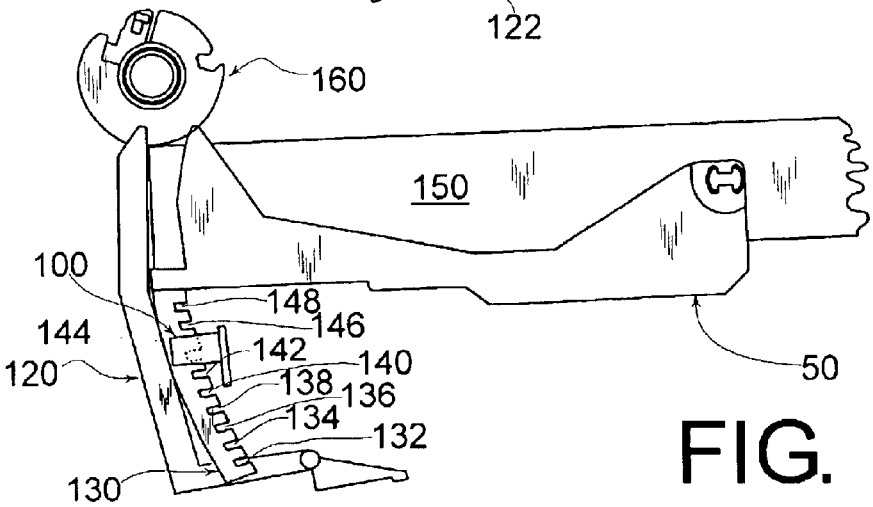
FIG. 12 shows a side elevation view of the lift plate and the picker assembly of FIG. 10 wherein the imaging apparatus is in a first 'snapshot' of a present/pick condition.
Figure 14:
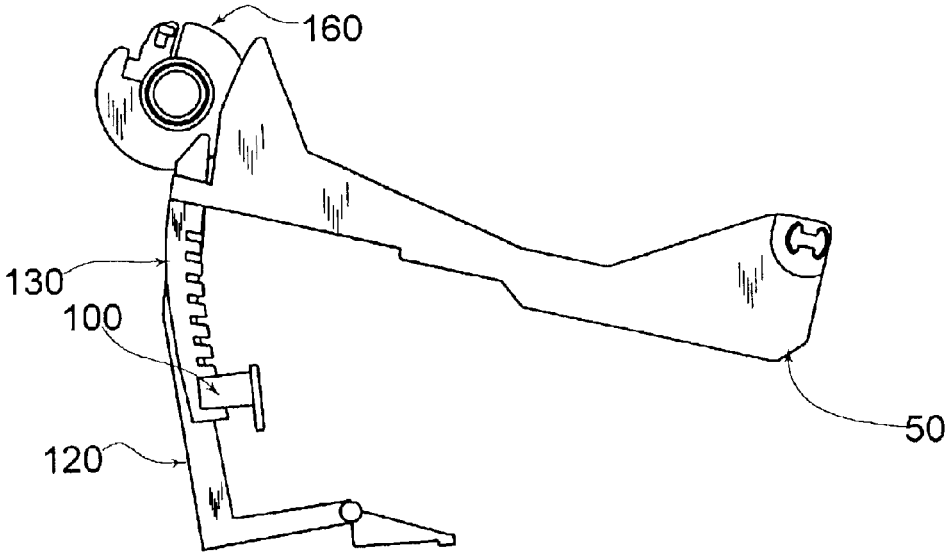
FIG. 14 shows a side elevation view of the lift plate and the picker assembly of FIG. 10 wherein the imaging apparatus is in an empty/pick condition.

As previously mentioned, the lift plate 50 may be in the load position (FIGS. 10 and 11) or the pick position (FIGS. 12 and 13). These load and pick positions may be referred to as conditions of the imaging apparatus 10 that represent 'snapshots' of the imaging apparatus 10 while it is being used. When the lift plate 50 is in the load position, the imaging apparatus 10 may be in an empty/load condition (FIG. 10) or a present/load condition (FIG. 11). When the lift plate 50 is in the pick position, the imaging apparatus 10 may be in a present/pick condition (FIG. 13) or an empty/pick condition (FIG. 14). It should be noted that the lift plate 50 is moved between the pick and load positions by the interaction of the lift plate actuator 162 and the springs 70, 72.

Empty/Load Condition

FIG. 10 shows a partial view of the imaging apparatus 10 in the empty/load condition. In this condition, the lift plate 50 is urged by the lift plate actuator 162 away from the picker assembly 160 such that the lift plate 50 is in the load position. In this empty/load condition, the springs 70, 72 (FIG. 1) may be compressed via the lift plate actuator 162, thereby allowing a user to insert media between the picker assembly 160 and the lift plate upper surface 64. As shown in FIG. 10, media is not disposed on the lift plate 50. Without the presence of media on the lift plate 50, the stack present flag 120 is located in-between the legs 106, 104 (FIG. 6) of the optical gate 100 (due to the weighted portion 122 causing rotation of the stack present flag 120 about the second axis A2). This location of the stack present flag 120 in the optical gate 100 may be sensed by the imaging apparatus 10 due to the blockage of light traveling on the light path Lp (FIG. 6). This blockage of light may be reported to the imaging apparatus 10 to notify the user that media is not present in the event that a printing operation is attempted. It should be noted that when the lift plate 50 is located in this empty/load condition, the light traveling along the light path Lp may line up with one of the graduations 131 (e.g. graduation 148, FIG. 8) on the stack thickness flag 130. This location of the graduation 148 in the light path Lp may allow for proper sensing of the stack present flag 120 by the optical gate 100. With this configuration (wherein graduation 148 does not disrupt the light path Lp) the stack thickness flag 130 does not interfere with the detection of the stack present flag 120.

Present/Load Condition

With reference to FIG. 11, a partial view of the imaging apparatus 10 is shown in the present/load condition. In this condition, the lift plate 50 may be urged away from the picker assembly 160 and the stack 150 is located on the lift plate 50. Additionally, the lift plate 50 remains in the load position. In this present/load condition, the springs 70, 72 (FIG. 1) may remain compressed by the force of the lift plate actuator 162. The presence of the stack 150 located between the picker assembly 160 and the lift plate 50 may be reported to the imaging apparatus 10 by the optical gate 100. With the presence of the stack 150 on the lift plate 50, the stack present flag 120 is not located in-between the optical gate legs 106, 104. Since the stack 150 contacts the contact portion 124 of the stack present flag 120, the stack present flag contact portion 124 may be rotated out of the optical gate 100 as shown. This lack of presence of the stack present flag 120 in the optical gate 100 is sensed by the imaging apparatus 10 (i.e. light may travel unobstructed along the optical gate light path Lp). This passage of light may be reported to the imaging apparatus 10 to notify the user that media is present in the event that a printing operation is attempted.

Present/Pick Condition

With reference to FIG. 12, a partial view of the imaging apparatus 10 is shown in a first variation of the present/pick condition (the second variation is shown in FIG. 13). It should be noted that these variations of the present/pick condition are 'snapshots' of the imaging apparatus 10 in operation. In this present/pick condition, the lift plate 50 is urged towards the picker assembly 160 by the springs 70, 72 and the stack 150 is present. In this present/pick condition, the springs 70, 72 (FIG. 1) compress a portion of the stack 150 between the picker assembly 160 and the lift plate 50. The location of the lift plate 50 may be determined by 'counting' the number of graduations 131 sensed by the optical gate 100 (as the graduations 131 pass through the optical gate 100). This determination of the location of the lift plate 50, in turn, is utilized for determining the thickness of the stack 150 by a process that will be described later herein. As shown in FIG. 12, the lift plate 50 (and the stack 150 disposed thereon) has moved from the load position of the present/load condition (FIG. 11) to this present/pick condition. Such movement of the lift plate 50 may be monitored by counting the number of times the optical gate 100 senses individual stack thickness flag graduations 131. The controller 21 (or, alternatively, a device to which the imaging apparatus 10 may be interfaced such as a computer) may monitor this lift plate 50 movement by counting the number of times the light path Lp is blocked. When moving from the load position to the pick position illustrated in FIG. 12, the optical gate 100 senses graduation 148 first. After graduation 148 is sensed by the optical gate 100, and as the lift plate 50 moves towards the picker assembly 160, the next graduation 146 may be sensed by the optical gate 100. After sensing graduation 146, the optical gate 100 may sense the next graduation 144. Depending on the graduation width W1 and the spacing width W2, a determination can be made about how far the lift plate 50 has moved until the stack 150 contacts the picker assembly 160. With the stack 150 contacting the picker assembly 160, sheets of media may be picked from the stack 150 and introduced to the media path 154.

While the imaging apparatus 10 is processing sheets of media, the stack thickness T decreases (as illustrated by comparing FIGS. 12 and 13). During this decrease, the imaging apparatus 10 can perform a calculation to estimate the sheet thickness Ts. When the imaging apparatus 10 processes sheets of media, a known number 'N' of sheets are processed. When, for example, a known number of sheets N are processed as one of the stack thickness flag graduations 131 (e.g. graduation 142) passes through the gate 100, the sheet thickness Ts can be determined according to the following equation:

$$Ts=W1/N; \text{ wherein,}$$

Ts is the sheet thickness;

W1 is the graduation width (FIG. 8); and

N is the known number of sheets processed.

After passing through a known distance (e.g. graduation width W1 or graduation spacing width W2), the sheet thickness Ts can be determined. For example, if the graduation width W1 is 0.06 inches and 15 sheets of media are processed as graduation 142 passes through the optical gate 100, then the sheet thickness Ts is about 0.004 inches. In a process described later herein, this sheet thickness Ts can be utilized for estimating the number of sheets contained within the stack 150.

With reference to FIG. 13, a partial view of the imaging apparatus 10 is shown in a second variation of the present/pick condition. In this second variation, the stack 150 has been reduced in thickness T due to depletion of the stack 150. In this second variation of the present/pick condition, the springs 70, 72 (FIG. 1) still compress the stack 150 between the picker assembly 160 and the lift plate upper surface 64. As previously described, the location of the lift plate 50 may be determined by counting the number of graduations sensed by the optical gate 100 (as the graduations pass through the optical gate 100). As shown in FIG. 13, the lift plate 50 (and the stack 150 disposed thereon) has moved from the first variation of the pick position (FIG. 12) to this second variation (FIG. 13). This movement of the lift plate 50 may be determined by counting the number of times the optical gate 100 senses graduations 131. With the present/pick condition of FIG. 13, the optical gate 100 senses graduation 144 at the outset (shown in FIG. 12). After the optical gate 100 senses graduation 144, and as the lift plate 50 moves towards the picker assembly 160, the next graduation 142 may be sensed by the optical gate 100. After sensing graduation 142, the optical gate 100 may sense the next graduation 140. After sensing graduation 140, the optical gate 100 may sense the next graduation 138. After sensing graduation 138, the optical gate 100 may sense the next graduation 136. Depending on the graduation width W1 and the spacing width W2, a determination can be made about how far the lift plate 50 moved during the image processing of a known number of sheets 'N' from the stack 150. The quantity of sheets processed during the image processing as the lift plate 50 moves from the first variation of the present/pick condition (FIG. 12) to the second variation of the present/pick condition (FIG. 13) may be monitored as previously described.

Empty/Pick Condition

With reference to FIG. 14, a partial view of the imaging apparatus 10 is shown in the empty/pick condition. In this condition, the stack 150 is not present and image processing can not occur because media is not available for the process. In this empty/pick condition, the springs 70, 72 (FIG. 1) may urge the lift plate upper surface 64 towards the picker assembly 160. The location of the lift plate 50 may be determined by counting graduations 131 in a manner previously described. It should be noted that media can not be placed on the lift plate 50 until the empty/load condition illustrated in FIG. 10 is provided.

Quantity Calculation

During image processing, the stack monitoring system may monitor the number of sheets of media contained in the stack 150. As previously described, the sheet thickness Ts can be determined after the stack thickness flag 130 passes through the gate 100 (e.g. one of the graduations 131 or the portion of the stack thickness flag 130 that separates the graduations 131 by the separation distance W2). A quantity 'Q' of sheets of media remaining within the stack 150 may then be determined by an equation:

$Q=T/Ts$ wherein,

Q is the number of sheets contained within the stack 150;

T is the thickness of the stack 150; and

Ts is the sheet thickness.

It should be noted that the exact thickness of the stack 150 is only known when the gate 100 senses a transition between the graduations 131. As such, calculation of the quantity of sheets Q is able to occur when a transition between graduations 131 occurs. During intermediate locations (i.e., when the gate light path Lp is located between one of the individual graduations 131), the number of sheets contained within the stack 150 Q may be determined by subtracting the last calculated quantity Q by the number of sheets processed since the last calculation. With the previously described exemplary scenario, the sheet thickness Ts was determined to be about 0.004 inches. If the stack thickness T is determined to be 1.23 inches, then the stack 150 contains about three hundred sheets of media.

This stack monitoring system may be provided as an application specific integrated circuit (ASIC) or as an algorithm associated with the controller 21. Alternatively, the stack monitoring system may be incorporated within the device to which the imaging apparatus 10 may be attached (e.g., a computer).

The stack monitoring system may be utilized to report the quantity Q of sheets contained within the stack 150 to the user. The quantity Q may also be reported by an audible tone, display or other method as required. In one exemplary embodiment the imaging apparatus 10 may be interfaced with a computer. In this exemplary embodiment, the user may access a control dialog box upon actuation of a print command. If the number of pages to be printed by the imaging device 10 exceeds the quantity Q of sheets contained within the stack 150, the user will be notified to add media to the stack 150 before printing starts. This notification may come in the form of a 'beep' or a message shown on a display (either located on the computer or the imaging assembly 10).

Alternative Embodiments

Alternative embodiments may be utilized as required. One such alternative may be to fixedly attach the stack thickness flag 130 to the imaging apparatus housing 12 (or the media tray 30) and attach the optical gate 100 to the lift plate 50.

In another embodiment, the stack monitoring system may be provided in conjunction with other types of imaging apparatus such as copy machines, facsimile machines, scanners, etc. Although the present disclosure is directed to a stack thickness monitoring system contained within a printer, it is to be understood that the apparatus and methods described herein may be utilized in any other type of device, such as the devices previously mentioned.

In another alternative embodiment, the optical gate 100 may operate on principles other than photoelectric. Other operating principles include, but are not limited to: Hall effect sensors wherein a coil and a magnetic pole (N or S) is moved by the coil to produce current flow, capacitive sensors, velocity sensors, etc.

In another alternative embodiment, the stack thickness flag 130 may have greater or fewer graduations 131. As shown in the figures, the stack thickness flag 130 may have nine individual graduations. Alternatively, the stack thickness flag 130 may be provided with more graduations, such as thirty for example. Such alternatives are considered to be a matter of design intent depending on issues such as media thickness, maximum number of sheets contained within the stack 150, average print quantity, physical limitations of the sensor, etc.

While illustrative embodiments have been described in detail herein, it is to be understood that these concepts may be otherwise variously embodied and employed and that the appended claims are intended to be construed to include such variations except insofar as limited by the prior art.

I claim:

1. A system for monitoring a stack of media contained within an imaging apparatus comprising:

a lift plate upon which said stack is disposed;

a gate located in said imaging apparatus, said gate comprising an open state and a closed stat;

a first flag attached to said lift plate, wherein said first flag is positioned in said gate, said first flag comprising at least one graduation;

wherein said imaging apparatus comprises a first condition and a second condition;

wherein, in said first condition, said first flag graduation is located in said gate thereby placing said gate in said open state;

wherein, in said second condition, said first flag graduation is not located in said gate thereby placing said gate in said closed state;

a second flag positionable in said gate; and wherein lack of presence of said stack causes said second flag to be located within said gate, thereby placing said gate in said closed state.

2. The system of claim 1 wherein said lift plate is movable between a load position and a pick position;

wherein, in said lift plate load position, said gate is in said open state; and wherein, in said lift plate pick position, said gate is in said closed state.

3. The system of claim 2 and further comprising:

a lift plate movement distance defined by the difference between said load position and said pick position;

a first quantity of sheets processed by said imaging system;

a second quantity of sheets contained in said stack, said second quantity determined by a calculation dependent on said first quantity of sheets processed by said imaging system and said lift plate movement distance.

4. The system of claim 1 wherein said gate takes the form of an optical gate comprising a light path.

5. The system of claim 1 and further comprising:

a plurality of graduations formed in said first flag, said graduations being positionable in said gate light path.

6. The system of claim 1 wherein said first flag is integrally formed on said lift plate.

7. The system of claim 1 and wherein said gate is fixedly located on said imaging apparatus.

8. A method of determining a quantity of sheets contained within a stack of media contained within an imaging apparatus, said method comprising:

providing a lift plate upon which said stack of media is disposed, said lift plate movable within a lift plate range;

moving said lift plate;

monitoring a movement distance of said lift plate within said lift plate range;

processing a known number of sheets of media;

after said processing, said moving and said monitoring, calculating said quantity of sheets contained within said stack according to a set of variables comprising:

said known number of sheets, said movement distance of said lift plate and said lift plate range.

9. The method of claim 8 wherein said calculating said quantity of sheets contained within said stack comprises calculating according to an equation:

quantity of sheets contained within said stack equals said known number of sheets divided by said movement distance multiplied by the quantity of: said lift plate range minus said movement distance of said lift plate.

10. A stack monitoring system for an imaging apparatus comprising:

means for monitoring movement of a lift plate upon which said stack is disposed;

means for monitoring a quantity of media processed by said imaging apparatus; and means for determining a quantity of media contained within said stack based upon said movement of said lift plate and said quantity of media processed by said imaging apparatus.

* * * * *

UNITED STATES PATENT AND TRADEMARK OFFICE

CERTIFICATE OF CORRECTION

PATENT NO. : 6,824,133 B2
DATED : November 30, 2004
INVENTOR(S) : Dean Richtsmeier It is certified that error appears in the above-identified patent and that said Letters Patent is hereby corrected as shown below:

Column 10,
Line 47, delete “stat;” and insert therefor -- state; --.

Signed and Sealed this

Thirtieth Day of August, 2005

JON W. DUDAS
*Director of the United States Patent and Trademark Office*